United States Patent [19]

Chittenden

[11] Patent Number: 5,075,900

[45] Date of Patent: Dec. 31, 1991

[54] COMBINATION GARMENT AND PURSE

[76] Inventor: Marilyn W. Chittenden, 10011 E. Sunnyslope La., Scottsdale, Ariz. 85258

[21] Appl. No.: 693,335

[22] Filed: Apr. 29, 1991

[51] Int. Cl.[5] ..... A41D 1/00

[52] U.S. Cl. ..... 2/94; 2/102; 2/108; 2/267; 2/268; 2/247; 2/95; 2/97; 224/257

[58] Field of Search ..... 2/94, 95, 97, 102, 108, 2/267, 268, 247; 224/257, 259, 264, 265, 266

[56] References Cited

U.S. PATENT DOCUMENTS

| | | | |
|---|---|---|---|
| 215,416 | 5/1979 | Vogel | 2/102 |
| 2,986,738 | 1/1961 | Zubiate | 2/2 |
| 3,266,070 | 8/1966 | O'Link | 2/102 |
| 3,529,307 | 9/1970 | Belson et al. | 2/102 |
| 4,475,251 | 10/1984 | Hopkins | 2/94 |
| 4,531,919 | 7/1985 | Ware | 2/69 |
| 4,637,075 | 1/1987 | Ingirisano | 2/102 |
| 4,637,076 | 1/1987 | Tartt et al. | 2/102 |
| 4,669,127 | 6/1987 | Swanson | 2/102 |
| 4,800,593 | 1/1989 | Ruffner | 2/102 |
| 4,879,768 | 11/1989 | McClees et al. | 2/268 |
| 4,887,318 | 12/1989 | Weinreb | 2/268 |
| 4,998,654 | 3/1991 | Bruzek et al. | 2/102 |
| 5,014,359 | 5/1991 | Hanson | 2/102 |

*Primary Examiner*—Werner H. Schroeder

*Assistant Examiner*—Gloria Hale

*Attorney, Agent, or Firm*—Mason, Kolehmainen, Rathburn & Wyss

[57] ABSTRACT

A combination garment and purse worn by a person as an article of clothing is adapted for carrying articles normally carried in a purse, handbag or briefcase and includes a garment of flexible sheet material having a back panel and a pair of side and frontal panels joined therewith. A fastener is provided for detachably securing confronting edges of the frontal panel when the garment is worn closed at the front. First pockets are provided accessible from inside of the garment for carrying articles and second pockets accessible from outside the garment are also provided for carrying articles. A resilient yoke is secured to the inside of the garment and includes a central neck segment extending across the back of a person at an upper level and a pair of forwardly extending shoulder segments joining the neck segment at opposite ends. The resilient yoke is padded and is effective for spreading the load of the garment and the articles carried thereby onto the wearer's back and shoulders over a relatively large area so that a wearer hardly notices when relatively heavy objects are being carried in contrast to a situation wherein the same weight of objects would be readily noticed when carried in a separate purse, briefcase or handbag with a handle or with a shoulder strap.

15 Claims, 3 Drawing Sheets

COMBINATION GARMENT AND PURSE

BACKGROUND OF THE INVENTION

1. Field of the Invention

The present invention relates to a new and improved combination garment and purse adapted to be worn by a person as an article of clothing such as a vest, jacket, coat, sweater, shirt, undergarment and especially adapted for carrying articles such as those normally carried in a purse, briefcase or handbag. In particular, the new and improved combination garment and purse garment may comprise a sleeveless vest member with a padded resilient yoke on the inside for spreading the load or weight of articles carried in pockets in the garment over a relatively wide area of the wearer's upper back and shoulders so as to enable a person to carry a relatively heavy total weight without noticing the heaviness in contrast to the noticeable fatigue which often results if the same weight of articles is carried in a separate purse, briefcase or handbag by hand or with a shoulder strap. The combination garment purse is desirable because it provides freedom for both hands of a person wearing the same to carry other articles and packages in addition to those normally carried in a purse, briefcase or handbag.

2. Background of the Prior Art

U.S. Pat. No. 4,800,593 discloses a protective garment for weightlifters designed to prevent bruising of the neck and upper torso from the bar of a weight used during normal weightlifting exercises.

U.S. Pat. No. 4,637,076 discloses a convertible vest bag which is convertible between a vest-like garment which is worn or a handbag that is carried after portions of the garment are disconnected and folded over in a relatively complex manner to form a handbag or purse.

U.S. Pat. No. 3,529,307 discloses a military infiltrator vest having pads in the shoulders.

U.S. Pat. No. 3,266,070 discloses an inflatable garment structure employing an inflatable bladder to provide flotation for a person wearing the garment in the water.

U.S. Pat. No. 2,986,738 discloses a cushioned shoulder covering useful for protecting the shoulder against kick-back forces occurring when a rifle or other firearm is discharged with the butt of the gunstock bearing against the shoulder.

U.S. Pat. No. 215,416 discloses a vest used as a substitute for ordinary suspenders.

OBJECTS OF THE INVENTION

None of the foregoing patents disclose a combination garment and purse as set forth herein which is provided with a load spreading yoke for reducing the fatigue of carrying a number of relatively heavy objects around with the person.

Accordingly, it is an object of the present invention to provide a new and improved combination garment and purse that is worn by a person as an article of clothing and adapted for carrying a wide variety of articles normally carried in a separate purse, briefcase or handbag, thus leaving the wearer with both hands free.

Yet another object of the present invention is to provide a new and improved combination garment and purse employing a padded resilient yoke on the interior thereof adapted to spread and disperse the load of articles carried over a relatively wide area of the upper back and shoulders of a person wearing the garment.

Yet another object of the present invention is to provide a new, and improved combination vest and purse garment which is adapted to handle a relatively large load of articles to be carried yet provide a garment which is attractive to wear and relatively inexpensive.

Still another object of the present invention is to provide a new and improved combination garment and purse which permits a wearer to have both hands free.

Yet another object of the present invention is to provide a new and improved combination garment and purse adapted to be worn as an article of clothing such as a vest, jacket, coat, sweater, shirt, etc.

BRIEF SUMMARY OF THE PRESENT INVENTION

The foregoing and other objects and advantages of the present invention are accomplished in an illustrative preferred embodiment of the invention comprising a combination garment and purse designed to be worn as an article of clothing by a person and especially adapted for carrying articles which are normally carried in a purse, briefcase or handbag, etc.. The illustrated embodiment of the combination garment and purse disclosed herein as an example of the invention includes a sleeveless vest formed of flexible fabric or sheet material including a back panel and a pair of side and frontal panels joined therewith. Fastening means is provided for detachably securing confronting edges of the frontal panels when the garment is worn in a closed configuration. A first group of pockets are provided which are accessible only from inside of the garment for carrying a variety articles. A second set or group of pockets accessible from outside of the garment are provided for carrying additional articles of varying size. The combination garment and purse of the present invention is provided with a resilient padded yoke of generally U-shaped configuration secured to the inside surface of the outer shell of the garment and the yoke includes an upper, central, neck segment adapted to extend across the upper back of the wearer and joined at opposite ends by a pair of forwardly extending shoulder segments which further help to spread and distribute the load of the articles carried over a relatively large surface area on a person's upper back and shoulders in a manner such that the whole or total weight of the articles carried is well distributed and does not result in a feeling of being overburdened as sometimes occurs when a heavy handbag, briefcase or purse, etc. is carried with relatively heavy articles therein and only a narrow strap or small handle is provided.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
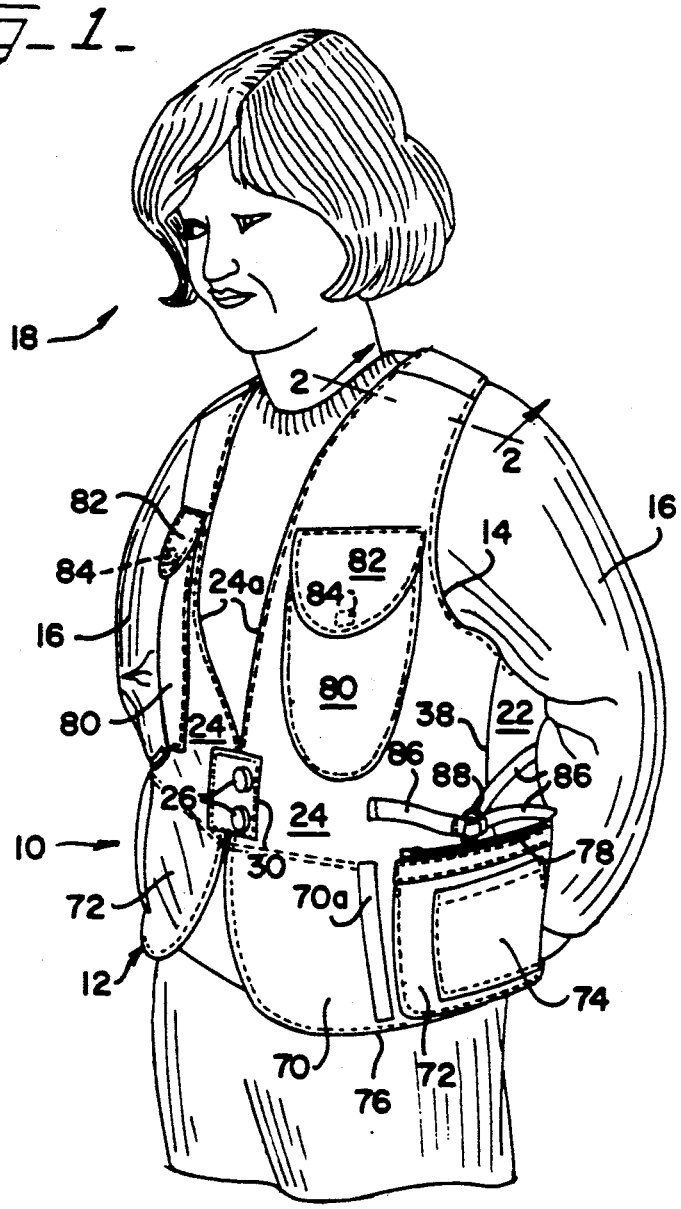
FIG. 1 is a front perspective view of a new and improved combination garment and purse shown as it is being worn as an article of clothing.

Referring now more particularly to the drawings, therein is illustrated a preferred embodiment of a new and improved combination garment and purse constructed in accordance with the features of the present invention and referred to generally by the reference numeral 10. The illustrated embodiment of the combination garment and purse 10 takes the form of a sleeveless, vest-like garment 12 made of flexible fabric or sheet material in a pattern or outline generally shown in FIGS. 3 and 4. It is to be understood that the combination garment and purse of the present invention may also take the form of an article of clothing such as a jacket, coat, sweater, shirt, undergarment, etc. and is not limited to a sleeveless vest as shown. The garment 12 is provided with arm openings 14 designed to accommodate the arms 16 of a person 18 (shown in standing position in FIG. 1) while wearing the combination garment and purse 10 as an article of clothing.

Figure 3:
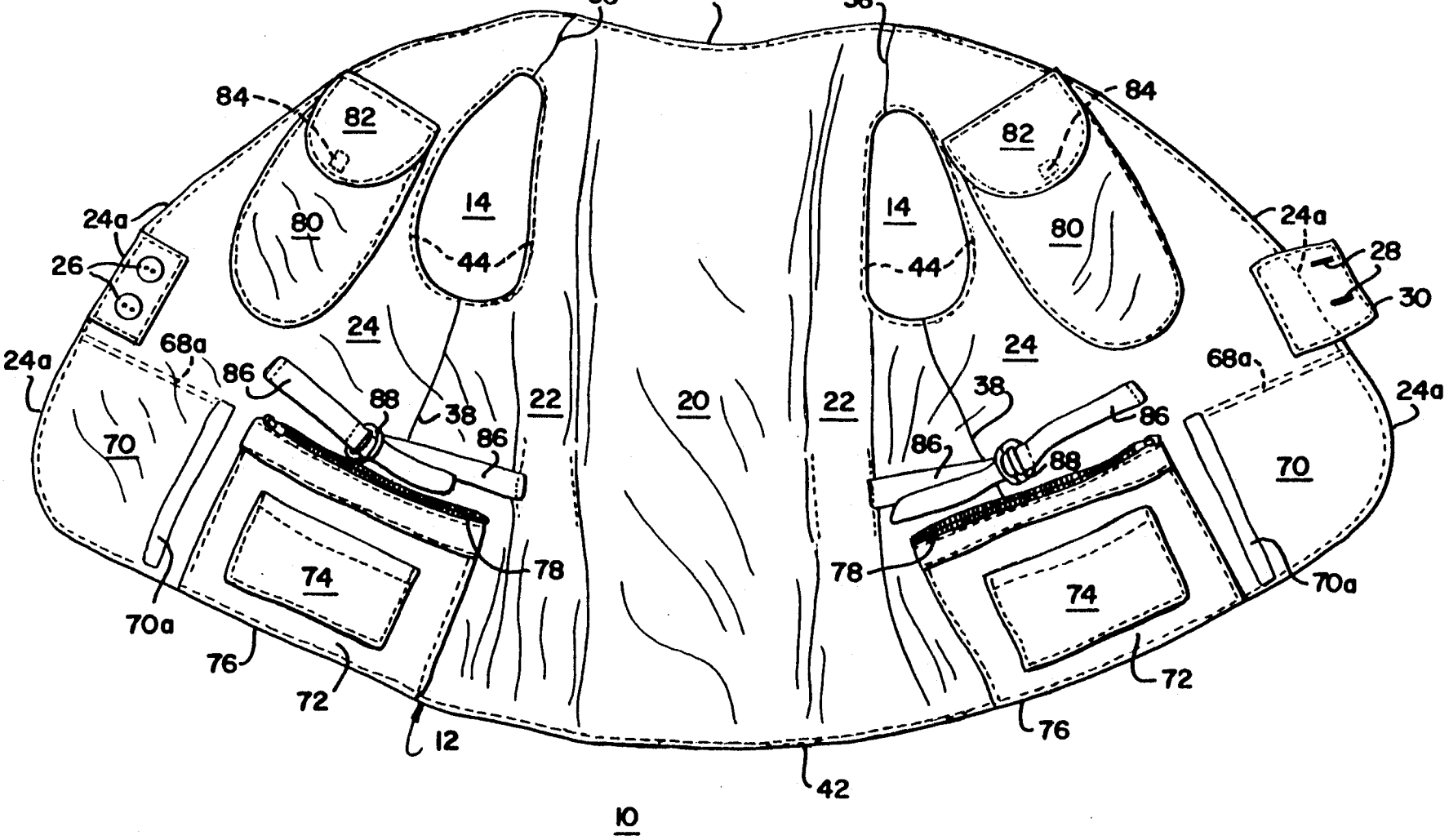
FIG. 3 is a plan view illustrating the outside surface of the combination garment and purse shown in a flattened-out condition for depicting the outline or pattern and components thereof.
Figure 4:
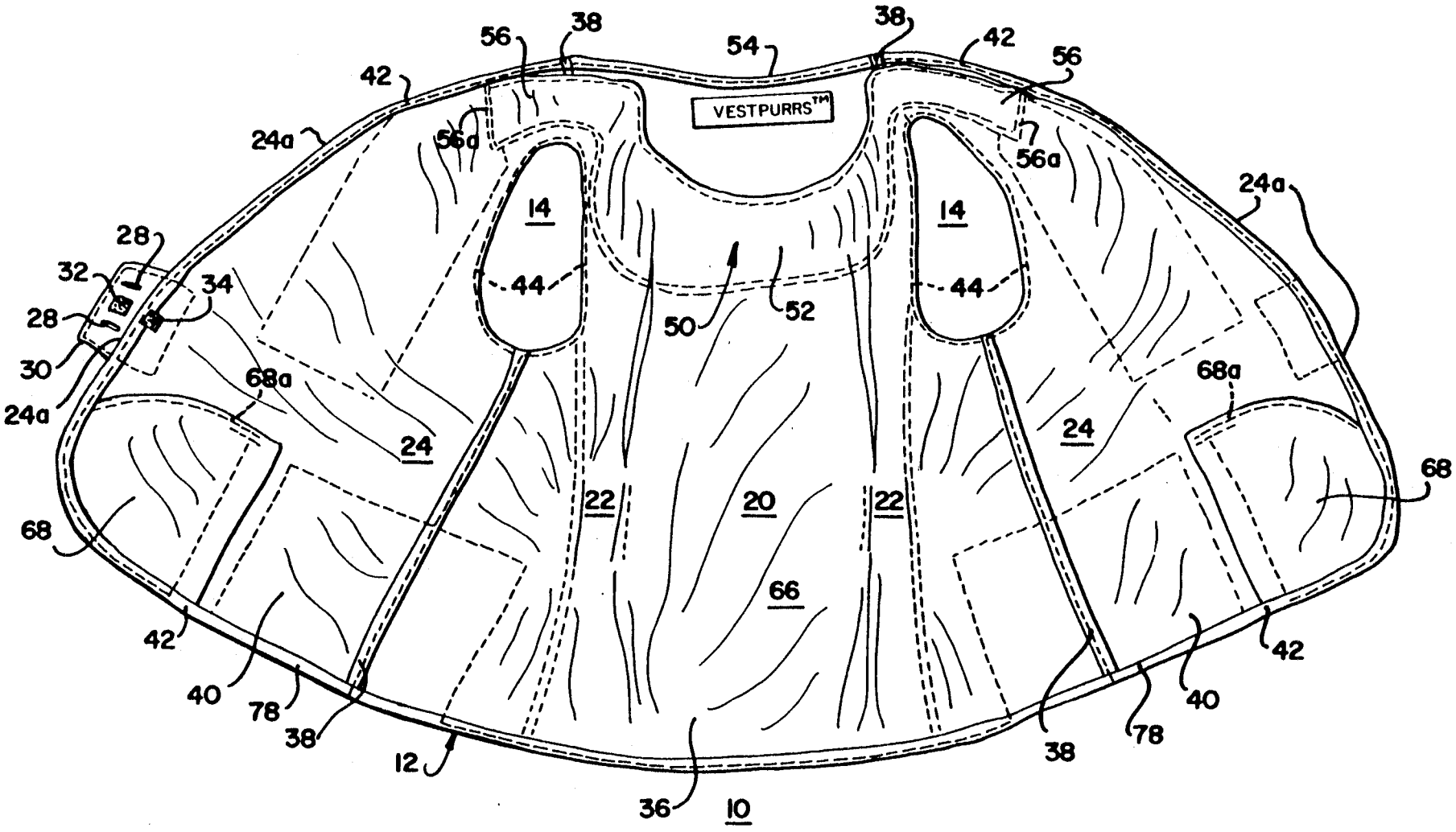
FIG. 4 is an inside view of the combination garment and purse also shown in a flattened-out condition to disclose the pattern and outline of components on the inside of the garment.

The outer shell of fabric of the vest garment 12 is cut in the pattern shown in FIGS. 3 and 4 and includes a back panel 20, side panels 22 along opposite edges of the back panel and front panels 24 joined to the side panels 22 along forwardly facing edges thereof. Each front panel 24 includes a forward edge 24*a* adapted to confront the forward edge 24*a* of the opposite front panel of the vest garment 12 when the garment is worn with the front closed as shown in FIG. 1.

Fastening means such as a pair of buttons 26 cooperating with the buttonholes 28 in a button flap 30 are provided for securing the confronting edges 24*a* together and closing the vest when worn. Cooperating "Velcro"-type fasteners 32 and 34 are provided on the inside surface of the button flap 30 and the adjacent front panel 24 as shown in FIG. 4 so that the button flap 30 may be folded over along the confronting edge 24 of the right hand front panel 24 when the vest garment 12 is worn in the open condition.

As illustrated best in FIG. 3, the outer shell of the vest garment 12 may be fabricated from three (3) separate pieces of material comprising a central section 36 including the back panel 20, the side panels 22 and portions of the front panels 24 and the central section 36 is joined on opposite edges along seam lines 38 to a pair of outer side sections 40 which form major portions of the front panels 24. The entire periphery of the joined-together central and outer section 36 and 40 is provided with a peripheral seam or decorative trim 42 and the arm openings 14 are similarly trimmed with a folded seam or peripheral trim 44 of oval shape around the arm openings.

Figure 2:
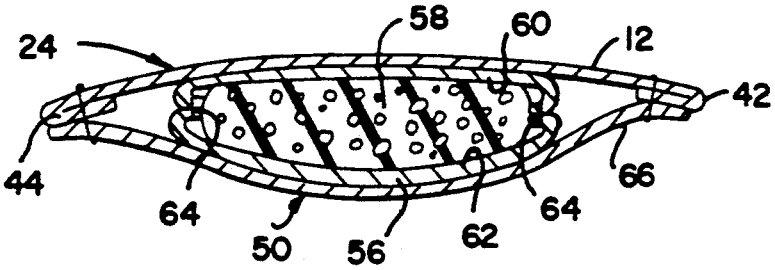
FIG. 2 is an enlarged fragmentary cross-sectional view taken substantially along lines 2—2 of FIG.

In accordance with the present invention, the combination vest and purse garment 10 includes a generally U-shaped, yoke 50 formed of relatively thick, flexible, resilient padding material as best shown in FIGS. 2 and 4. The yoke 50 is secured to the inside of the vest member 12 and includes a central segment 52 extending laterally across an upper portion of the back panel 20 spaced below a neck line or upper edge 54 thereof. The central segment or bight portion 52 of the yoke 50 is integrally joined at opposite end portions to a pair of outwardly and forwardly extending legs or shoulder segments 56 projecting forwardly and downwardly over the shoulders of the wearer 18 to terminate at lower ends 56*a* (FIG. 4) on the front panels 24.

As illustrated in FIG. 2 which shows a cross-section through one of the shoulder segments 56 of the U-shaped yoke 50, a relatively thick padding of flexible, resilient textile or foam material 58 is encased within a pair of inner and outer fabric members 60 and 62 joined together along peripheral edges by a continuous seam 64. The internal padding or body material 58 of the U-shaped yoke 50 acts to disperse and spread the load of the combination vest and purse garment 20 and the articles carried thereby over a relatively wide surface area of both shoulders and upper back of the wearer 18. Because the surface area of the yoke 50 engages i both (2) shoulders and the back and is relatively large in comparison to a strap or handle provided on handbags, purses and the like, the loading pressure on the skin of the wearer is drastically reduced even though the same weight of articles may be carried. The padded body 58 can be formed of flexible polyurethane foam or other types of material which readily conform to the surface of the wearer's body adjacent thereto. If desired, the entire inner surface of the vest garment 12 may be provided with a liner 66 of lightweight rayon, cotton or other fabric material and the liner generally covers over the yoke 50 as shown in FIG. 2.

In accordance with the present invention, the new and improved vest and purse garment 10 includes a plurality of interior pockets 68 so that articles may be carried unnoticed inside the vest when worn and these interior pockets may be located adjacent the lower front corners of the vest 12 with generally horizontally extending openings having seams 68*a* as shown in FIG. 4. A wide variety of articles may be carried in the interior pockets 68 and protected from exposure to elements outside of the vest garment 12. In addition to the interior pockets 68, the outer surface of the vest garment 12 is provided with a plurality of exterior pockets 70, 72 and 74 positioned adjacent a lower edge 76 of the front panels 24 and side panels 22 forming part of the peripheral edge 42. Corner pockets 70 may be provided with vertically extending side openings 70*a* to readily accommodate the hands of the wearer 18 and large, patch-type pockets 72 may be provided with a zipper 78 or other closure mechanism along an upper edge for securing articles contained in the pockets 72. Smaller pockets 74 may be provided on the outer leaf of the larger pockets 72 for containing smaller items such as credit cards and the like.

In addition to the lower exterior pockets 70, 72 and 74, the combination vest and purse garment 10 also includes a pair of patch-type upper pockets 80 having flaps 82 and "Velcro"-type closure patches 84 for detachably closing the flaps to provide security for articles contained in the upper pockets 80.

In order to accommodate persons 18 of different size and girth, the combination garment and purse 10 is provided with pairs of adjustment straps 86 on each side adjustably interconnected with a buckle assembly or other types of fastening devices 88.

The interior pockets 68 and the exterior pockets 70, 72, 74 and 80 of the vest and purse garment are sized and positioned appropriately to carry a wide variety of articles that may be commonly found in a purse or handbag. The combined weight of all the articles carried in the vest purse garment 10 may be relatively high, but the load of the articles is dispersed and distributed by the U-shaped yoke element 50 and the interior padding body 58 of resilient material. Because the load is dispersed over a wide area on the wearer's upper back and shoulders, the load goes almost unnoticed. The vest and purse garment can be worn inside of other coats or sweaters and also may be worn as an outer garment in either an open or closed condition.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A combination garment and purse be worn by a person as an article of clothing and for carrying articles normally carried in a purse, hangbag, briefcase comprising:

a garment formed of flexible sheet material including a back panel, a pair of side panels and frontal panels joined therewith;

pocket means for carrying one or more articles;

resilient flexible yoke means secured to the inside of said garment comprising a central neck segment extending across said back of said garment at an upper level said back having opposite end portions and a pair of shoulder segments joining said opposite end portions of said central neck segment and extending forwardly thereof toward said frontal panels including pad means for cushioning and spreading the load of said vest and articles carried in said pocket means across the upper back and shoulders of a person wearing said garment as an article of clothing.

2. The combination garment and purse of claim 1, wherein:

said resilient yoke means includes a resilient pad of substantial thickness and a fabric cover over said pad for engagement with surfaces on the upper back and shoulders of said person wearing said garment.

3. The combination garment and purse of claim 1, wherein:

said resilient yoke means is of a generally U-shaped configuration having a bight forming said central neck segment and a pair of legs forming said shoulder segment.

4. The combination garment and purse of claim 1, wherein:

said back including opposite edge portions; and including adjustable length strap means extending from opposite edge portions of said back and joined to said frontal panels for adjusting the breadth of said garment to fit persons of different size.

5. The combination garment and purse of claim 1 wherein:

said pocket means includes an inside pocket positioned on said frontal panel of said garment.

6. The combination garment and purse of claim 5, wherein:

said pocket means includes a pair of said inside pockets, each of said inside pockets positioned adjacent a lower edge of a respective frontal panel adjacent an edge thereof.

7. The combination garment and purse of claim 6, wherein:

each of said inside pockets is open along an upper edge thereof.

8. The combination garment and purse of claim 1, wherein:

said pocket means includes one or more outside pockets positioned on said front panel of said garment.

9. The combination garment and purse of claim 8, wherein:

said one or more outside pockets are positioned adjacent a lower edge of said frontal panel of said garment.

10. The combination garment and purse of claim 9, including:

at least one of said outside pockets is provided on each of said frontal panels of said garment.

11. The combination garment and purse of wherein:

said pocket means includes at least one outside pocket positioned to extend over a side portion and over or adjacent a frontal panel of said garment adjacent to said side portion.

12. The combination garment and purse of claim 11, wherein:

said pocket means includes at least one upper level outside pocket positioned above the level of said one outside pocket.

13. The combination garment and purse of claim 8, including:

at least one upper level outside pocket located on a frontal panel of said garment above said one or more outside pockets.

14. The combination garment and purse of claim 1, wherein:

said frontal panels include confronting edges; and fastening means for detachably securing said confronting edges together.

15. The combination garment and purse of claim 1, including:

liner means of flexible sheet material covering said yoke means.

* * * * *

UNITED STATES PATENT AND TRADEMARK OFFICE

CERTIFICATE OF CORRECTION

PATENT NO. : 5,075,900

DATED : December 31, 1991

INVENTOR(S) : Marilyn W. Chittenden

It is certified that error appears in the above-identified patent and that said Letters Patent is hereby corrected as shown below:

Col. 4, line 16, delete "i";

Col. 5, line 16, after "purse" insert -- to --;

Signed and Sealed this

Twenty-second Day of June, 1993

*Attest:*

Michael K. Kirk

MICHAEL K. KIRK

*Attesting Officer*

*Acting Commissioner of Patents and Trademarks*